US007185464B2

(12) United States Patent
Bracale

(10) Patent No.: US 7,185,464 B2
(45) Date of Patent: Mar. 6, 2007

(54) TUBULAR SKYLIGHT FOR LIGHTING ROOMS WITH NATURAL LIGHT

(76) Inventor: Gennaro Bracale, Via Cesare Battisti, 15, 21027 Ispra (IT)

( * ) Notice: Subject to any disclaimer, the term of this patent is extended or adjusted under 35 U.S.C. 154(b) by 472 days.

(21) Appl. No.: 10/274,195

(22) Filed: Oct. 21, 2002

(65) Prior Publication Data

US 2003/0079422 A1 May 1, 2003

(30) Foreign Application Priority Data

Oct. 29, 2001 (IT) ..... MI2001A2272
Mar. 15, 2002 (EP) ..... 2005373

(51) Int. Cl.
*E04D 13/03* (2006.01)
*E04D 13/18* (2006.01)

(52) U.S. Cl. ..... 52/200; 52/173.3; 52/171.1; 359/591; 359/599; 359/742; 362/557

(58) Field of Classification Search ..... 52/200, 52/173.3, DIG. 8, 28, 171.1; 359/591, 592, 359/599, 742; 362/557
See application file for complete search history.

(56) References Cited

U.S. PATENT DOCUMENTS 1,254,520 A * 1/1918 MacDuff ..... 359/597
2,055,696 A * 9/1936 Marshall ..... 352/140
2,858,734 A * 11/1958 Boyd ..... 359/593
2,918,023 A * 12/1959 Bettcher ..... 52/22
3,001,437 A * 9/1961 Taylor ..... 359/599
3,111,786 A * 11/1963 Wasserman ..... 52/22
3,307,303 A * 3/1967 Bloxsom ..... 52/200
3,440,331 A * 4/1969 Cohen ..... 174/61
3,511,559 A * 5/1970 Foster ..... 359/591
4,198,953 A * 4/1980 Power ..... 126/617
4,306,769 A * 12/1981 Martinet ..... 359/597
4,344,261 A * 8/1982 Weisner et al. ..... 52/200
4,549,379 A * 10/1985 Hoy et al. ..... 52/200
4,593,976 A * 6/1986 Eijadi et al. ..... 359/593
4,928,666 A * 5/1990 Mori et al. ..... 126/623
5,022,381 A * 6/1991 Allegro ..... 126/622
5,092,089 A * 3/1992 Kessler ..... 52/200
5,099,622 A 3/1992 Sutton
5,550,673 A * 8/1996 Goldstein ..... 359/367

(Continued)

FOREIGN PATENT DOCUMENTS

JP 1-299945 * 12/1989 ..... 52/200

(Continued)

OTHER PUBLICATIONS

Patent Abstracts of Japan vol. 1999, No. 04, Apr. 30, 1999-& JP 11 002779 A (Sanyo Electric Co Ltd), Jan. 6, 1999 *abstract; figures 1, 3*.

*Primary Examiner*—Phi Dieu Tran A
(74) *Attorney, Agent, or Firm*—Modiano & Associati; Albert Josif; Daniel O'Byrne

(57) ABSTRACT

A tubular skylight for lighting rooms with natural light, comprising a tubular body with a reflective inner surface which leads into a room and has, at its external end, a natural light collector assembly and, at its internal end, a light diffuser. The collector assembly comprises, inside an optically transparent dome arranged so as to close the tubular body, a mirror-finished body which is substantially shaped like a cylindrical band with mirror-finished inner and outer surfaces. The axial width of the band-like body varies gradually from a minimum-width point to a maximum-width point, which lie diametrically to each other. It is also possible to provide a cylindrical refracting body that surrounds said mirror.

13 Claims, 5 Drawing Sheets

U.S. PATENT DOCUMENTS

| | | | | | |
|---|---|---|---|---|---|
| 5,596,848 | A * | 1/1997 | Lynch | 52/200 |
| 5,648,873 | A * | 7/1997 | Jaster et al. | 359/591 |
| 5,896,713 | A * | 4/1999 | Chao et al. | 52/200 |
| 6,035,593 | A * | 3/2000 | Chao et al. | 52/200 |
| 6,155,008 | A * | 12/2000 | McKee | 52/198 |
| 6,219,977 | B1 * | 4/2001 | Chao et al. | 52/200 |
| 6,256,947 | B1 * | 7/2001 | Grubb | 52/200 |
| 6,433,932 | B1 * | 8/2002 | Aoki et al. | 359/597 |
| 6,528,782 | B1 * | 3/2003 | Zhang et al. | 250/226 |
| 2003/0150175 | A1 * | 8/2003 | Rillie | 52/200 |

FOREIGN PATENT DOCUMENTS

| | | | | |
|---|---|---|---|---|
| JP | 2-240353 | * | 9/1990 | 52/200 |
| JP | 4-323451 | * | 11/1992 | 52/200 |

* cited by examiner 2
36
41
32
30
41
31
35
40
42
41

TUBULAR SKYLIGHT FOR LIGHTING ROOMS WITH NATURAL LIGHT

BACKGROUND OF THE INVENTION

The present invention relates to a tubular skylight for lighting rooms with natural light.

It is known that tubular skylights for lighting rooms with natural light are already commercially available which generally have a tubular body with a reflective internal surface which has, at its upper end, a natural light collector assembly, which is generally constituted by an optically transparent dome-like body which internally encloses a mirror arranged so as to optimize sunlight collection.

The mirror that is currently used has a prism-like shape and is capable of reflecting rays that arrive from a single direction, since the mirror is arranged proximate to one edge of the tubular element. Moreover, in order to increase the incoming light, prism-like surfaces are formed on the dome which facilitate the redirection of the rays that otherwise would not enter the tubular element.

The constructive solutions that are adopted currently do not allow to obtain prisms with a correct angle, since said prisms are provided directly on the surface of the dome, which is usually inclined, and therefore the function of currently provided refracting prisms is reduced significantly with respect to the potential of the rays that can be collected.

SUMMARY OF THE INVENTION

The aim of the present invention is to eliminate the above mentioned drawbacks, by providing a tubular skylight for lighting rooms with natural light that allows to optimize sunlight collection, particularly as regards the rays reflected by the mirror-finished surface.

Within this aim, a particular object of the invention is to provide a skylight in which it is possible to increase significantly the quantity of rays diverted by refraction, by way of the possibility to optimize the shape of the prisms with respect to the source of the rays and the shape of the tubular element.

Another object of the present invention is to provide a tubular element that can be easily coupled to the light diffuser arranged inside the room, thus optimizing the quantity of rays that is introduced and also simplifying all production work.

Another object of the present invention is to provide a tubular skylight which thanks to its particular constructive characteristics is capable of giving the greatest assurances of reliability and safety in use and is further competitive from a merely economical standpoint.

This aim and these and other objects that will become better apparent hereinafter are achieved by a tubular skylight for lighting rooms with natural light, according to the invention, which comprises a tubular body with a reflective inner surface which leads into a room and has, at its external end, a natural light collector assembly and, at its internal end, a light diffuser, characterized in that said collector assembly comprises, inside an optically transparent dome arranged so as to close said tubular element, a mirror-finished body which is substantially shaped like a cylindrical band with mirror-finished inner and outer surfaces.

BRIEF DESCRIPTION OF THE DRAWINGS

Further characteristics and advantages will become better apparent from the description of a preferred but not exclusive embodiment of a tubular skylight for lighting rooms with natural light, illustrated only by way of nonlimitative example in the accompanying drawings, wherein.

DESCRIPTION OF THE PREFERRED EMBODIMENTS

Figure 1:
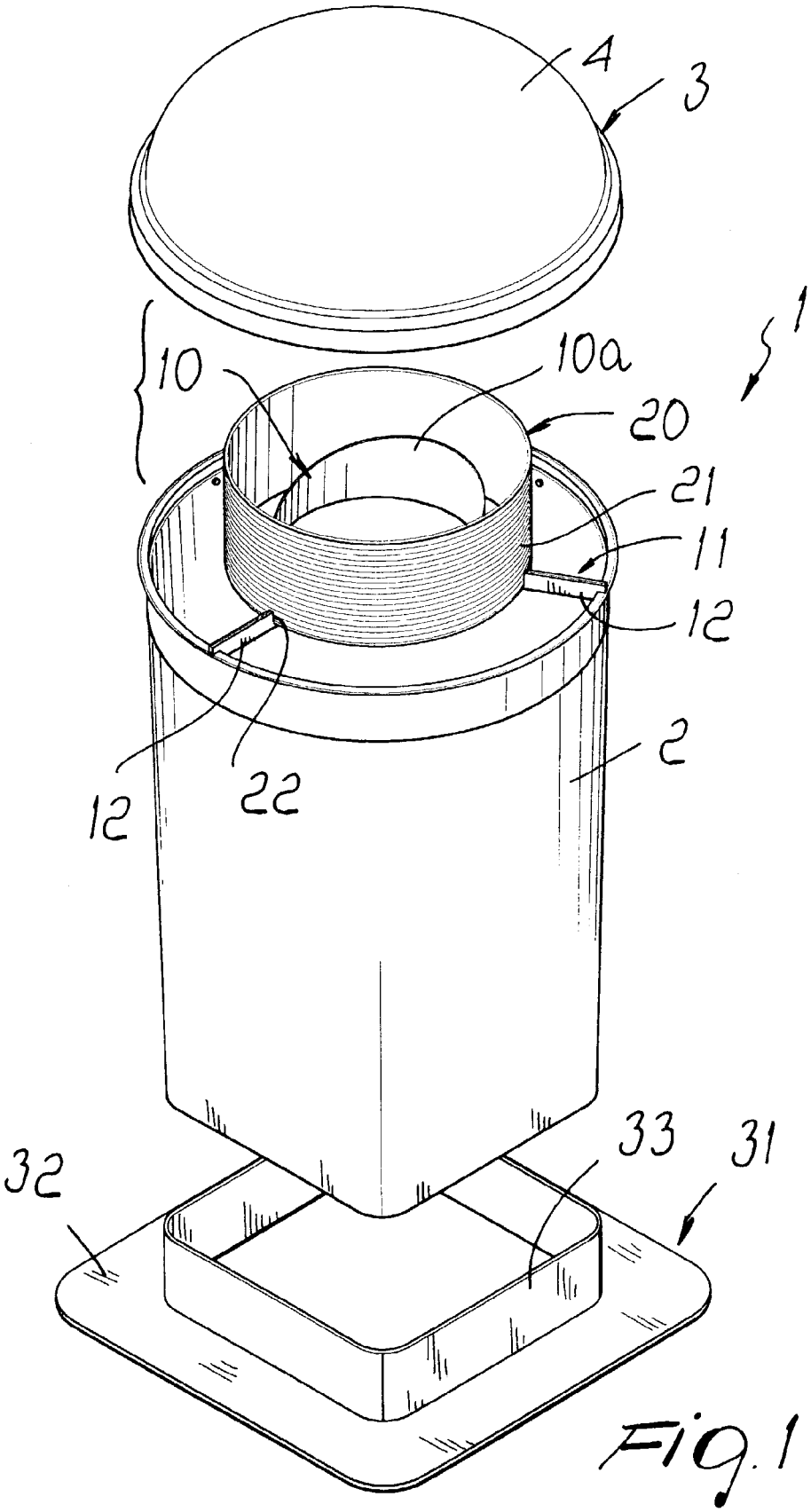
FIG. 1 is a schematic exploded perspective view of the tubular skylight.

With reference to the figures, the tubular skylight for lighting rooms with natural light according to the invention, generally designated by the reference numeral 1, comprises a tubular body 2 with a reflective internal surface, which is provided so as to lead, at its lower end, into the room to be lit and has, at its other end or external end, a collector assembly generally designated by the reference numeral 3.

Figure 2:
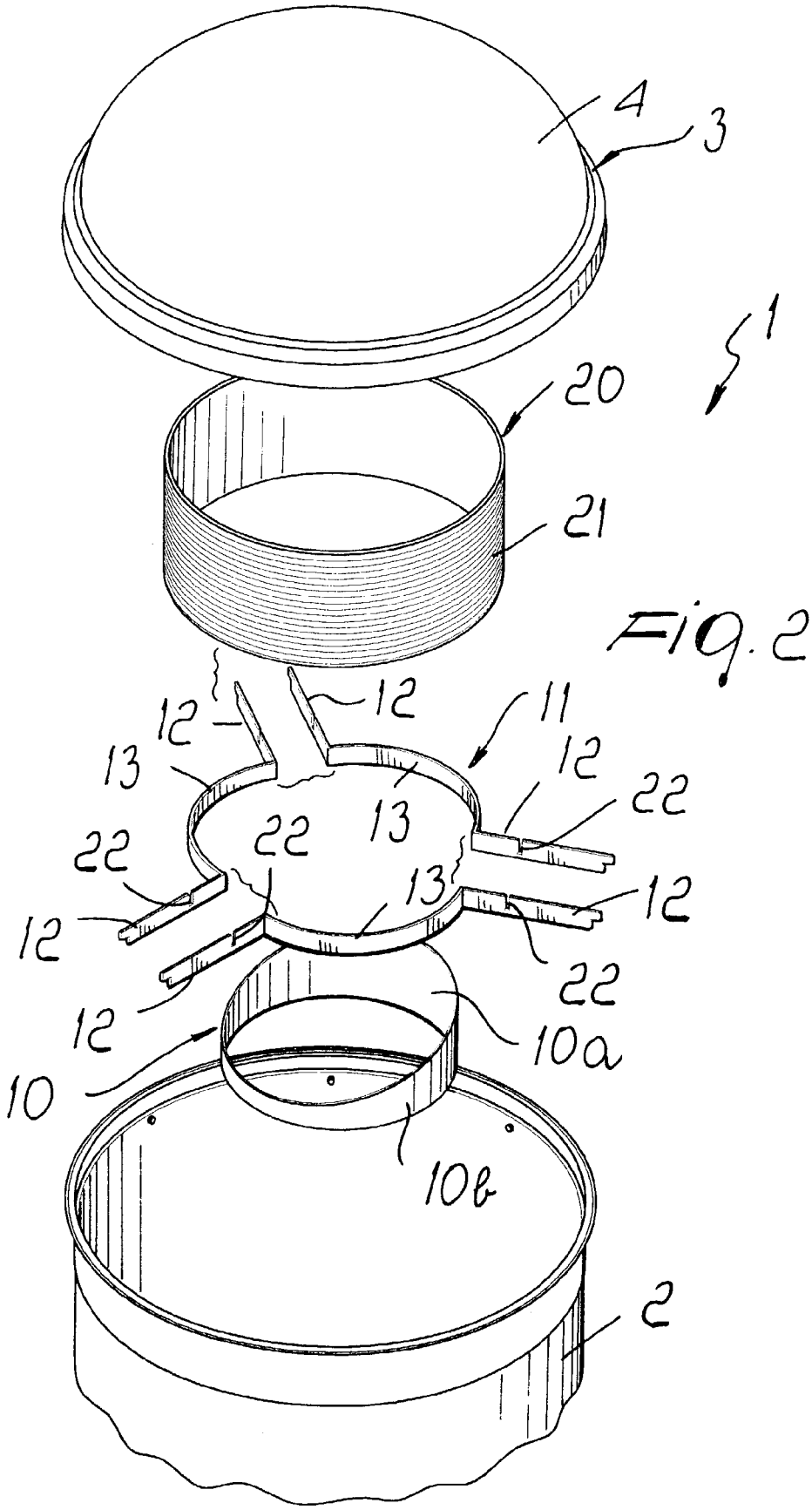
FIG. 2 is an exploded perspective view of the collector assembly.
Figure 3:
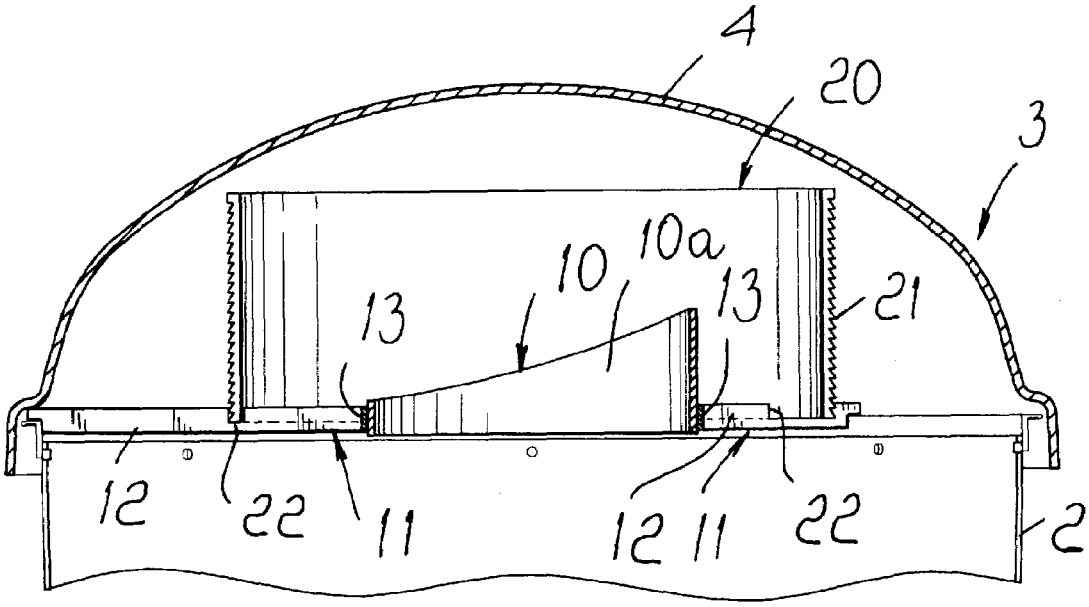
FIG. 3 is a diametrical sectional view of the collector assembly.
Figure 4:
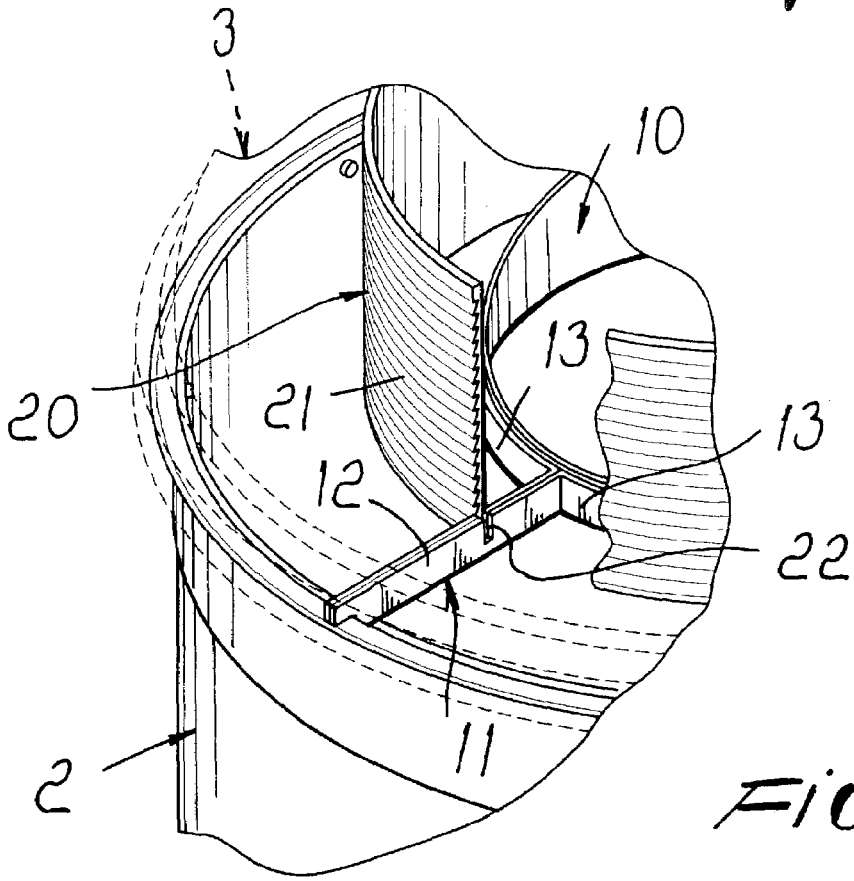
FIG. 4 is a partially cutout perspective view of a detail of the collector assembly.
Figure 5:
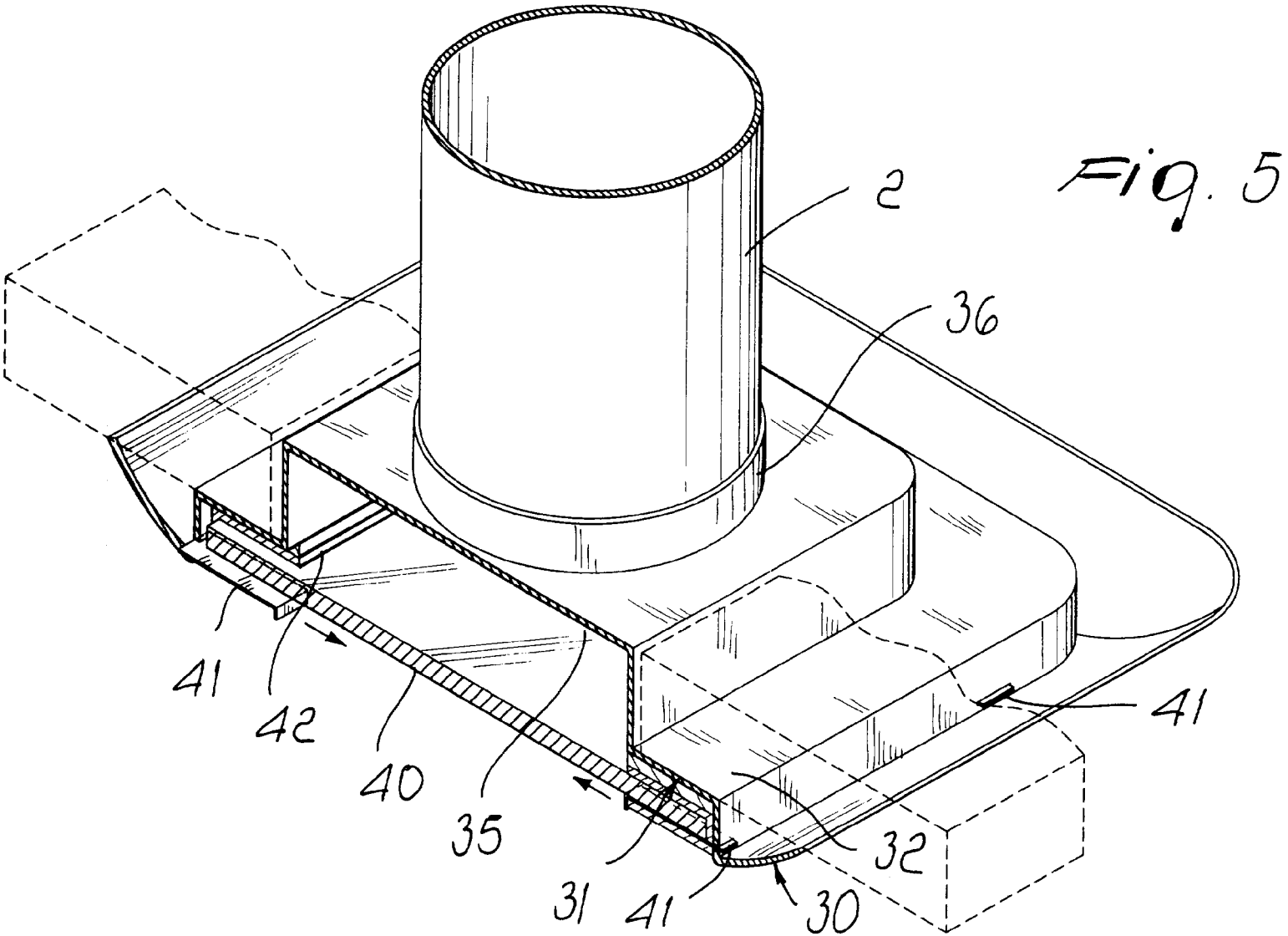
FIG. 5 is a sectional view of the light diffuser.

The collector assembly, as shown more clearly in FIG. 2, has an optically transparent dome 4, which is arranged so as to close the upper end of the tubular element 2 and internally encloses a mirror-finished body 10, which is advantageously formed by a cylindrical band in which the inner surface 10*a* and the outer surface 10*b* are both mirror-finished.

Advantageously, the body 10 has an axial width that can vary gradually from a point of minimum width to a point of maximum width, which are arranged at right angles to each other.

The mirror-finished body 10 is supported coaxially inside the upper end of the tubular body 2 by means of brackets 11 which are provided with spokes 12 connected to the rim of the tubular element and have a central portion 13 for connection to the mirror-finished body 10.

With the described arrangement, therefore, the mirror-finished body is capable of reflecting toward the inner wall of the tubular body 2 rays that arrive from all directions and with any inclination.

Moreover, the shape in which the end is in practice cut obliquely owing to the width that can vary from a maximum to a minimum that are arranged diametrically optimizes light ray collection by arranging the internal surface of the wider point so that it faces south.

In order to collect rays with various inclinations, there is a refracting body 20, which is constituted by a cylindrical body with an outer surface 21 formed by prisms, of the Fresnel-lens type, designed to redirect the incoming rays in a more favorable direction.

The refracting body 20 is applied coaxially externally with respect to the mirror-finished body 10 and is advantageously supported by the spokes 12 of the brackets 11, which have notches 22 for the coupling of the cylindrical body.

The refracting body might also be used without the presence of the mirror and can be obtained by means of prisms that have particular shapes. Moreover, the refracting body, when used in combination with the mirror, can have a missing circumferential portion.

Figure 6:
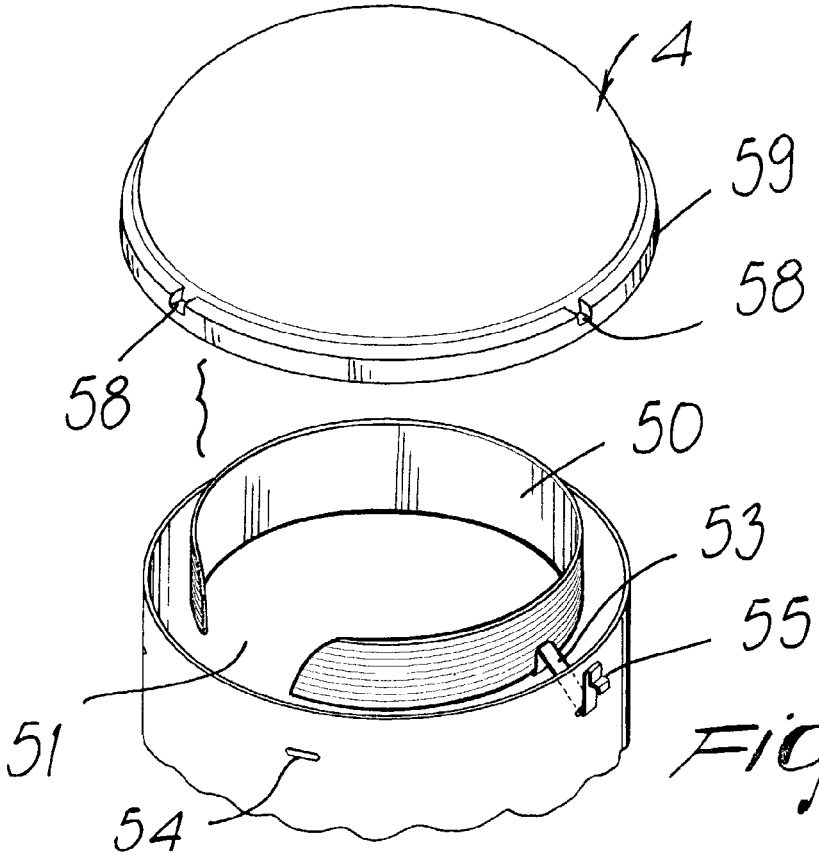
FIG. 6 is a partially exploded view of an embodiment in which the collector assembly is provided by means of an annular refracting body.
Figure 7:
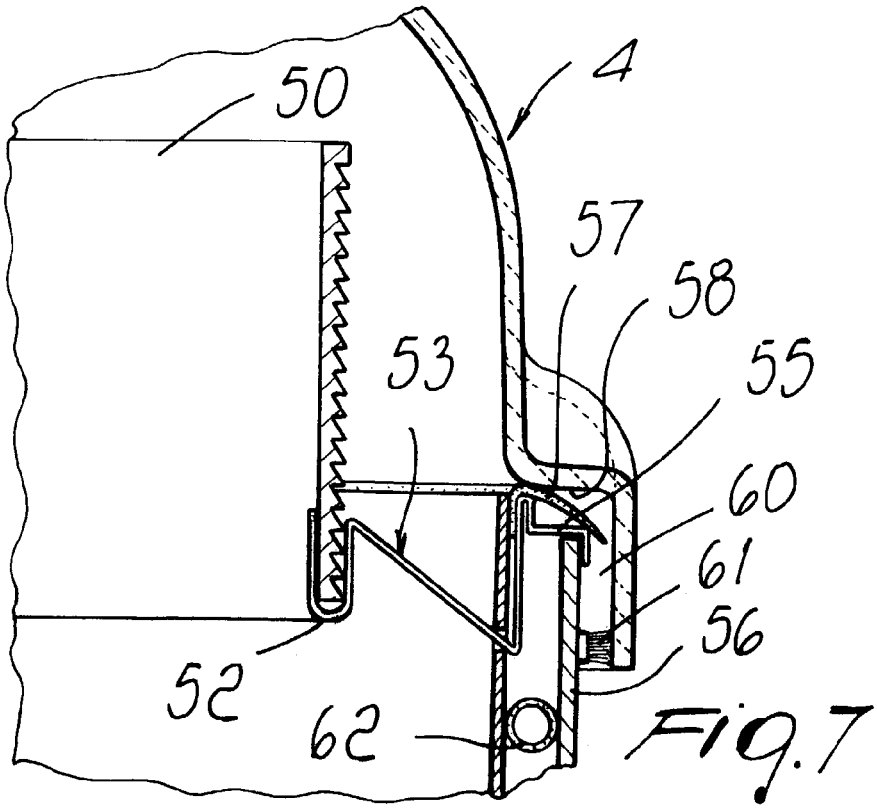
FIG. 7 is a diametrical sectional view of the embodiment of FIG. 6.

As shown in FIGS. 6 and 7, the collector assembly can have an annular refracting body 50, which has a microcorrugated outer surface obtained by means of prisms that are mutually parallel and have a variable apex angle.

The annular body has a smooth inner surface in order to be substantially reflective for the light that is incident thereon.

Advantageously, the annular refracting body can have a discontinuity 51 of a few tens of degrees in the south-facing part.

It should be added to the above that the refracting body 50 can be supported by the bend 52 arranged at the end of a hook-like element 53 that supports the tubular body 2, engaging in slots 54 formed therein. At the other end, the hook-like element 53 forms an engagement bend 55, which overlaps the supporting structure 56.

In order to improve the seal, there is an upper gasket 57, which is superimposed on the supporting structure 56 and acts as a support for recesses 58 formed on the rim 59 of the dome 4 in order to provide circumferential slots for the passage of any condensation, which flows from the internal surface of the dome toward the peripheral region of the dome, entering the interspace 60 formed between the rim 59 and the supporting structure 56.

The interspace 60 is closed by a brush-type gasket 61, which facilitates outward drainage of condensation.

There is also an airtight gasket 62 between the structure 56 and the tubular body 2.

In a downward region, the tubular element is connected to a diffuser, generally designated by the reference numeral 30, which has a frame-like body 31 with flanges 32 that allows connection to the roof or ceiling by passing within the roof members.

The flange 32 can have a rim 33 with rounded corners, which has the same perimetric extension with respect to the circumference of the tubular element and can thus mate, assuming a square shape as shown schematically in FIG. 1.

Optionally, inside the flange 32 it is possible to provide a conventional box-like body 35 with a circular inlet 36 for the connection of the tubular element.

The frame-like body 31 supports a plate 40, made of translucent material, which acts as a trimming element and is supported by conventional locking elements 41 accommodated in the perimetric profile 42 of the plate of opalescent material in order to allow quick and easy coupling and uncoupling of the plate with respect to the frame-like body 31.

With the above described arrangement it is therefore evident that the invention achieves the intended aim and objects, and in particular the fact is stressed that a tubular skylight is provided in which the adoption of a mirror-finished body having a particular shape allows to increase significantly the quantity of collected and reflected rays, both by means of the increase in surface and by way of the fact that the mirror-finished body has mirror-finished surfaces on its inner face and on its outer face.

Further, the provision of a refracting body such as the cylindrical element separated from the dome allows first of all to provide prism-like lenses with an optimum angle and secondly allows to simplify considerably the steps of production, since the prism-like cylindrical body can be obtained simply with a band-like element that is folded during installation.

The invention thus conceived is susceptible of numerous modifications and variations, all of which are within the scope of the inventive concept.

All the details may further be replaced with other technically equivalent elements.

In practice, the materials used, as well as the contingent shapes and dimensions, may be any according to requirements.

The disclosures in Italian Patent Application No. MI2001A002272 and European Patent Application No. 02005373.2, from which this application claims priority, are incorporated herein by reference.

What is claimed is:

1. A tubular skylight for lighting a room with natural light, comprising: a tubular body having a reflective inner surface extending between a first external end exposed to natural light and a second internal end of the tubular body which reaches a region to be lit; a natural light collector assembly arranged at said first end of the tubular body; a light diffuser arranged at said second end of the tubular body; the light collector assembly comprising an optically transparent dome arranged so as to close said tubular body at said first end; a mirror-finished cylindrical body arranged inside said transparent dome and formed by a cylindrical band with mirror-finished inner and outer surfaces; and a refracting, cylindrical body; the refracting body ranged on said tubular body, inside, and separately from the transparent dome and externally to, and coaxial with said mirror-finished cylindrical body.

2. The tubular skylight of claim 1, wherein said mirror-finished body shaped as a cylindrical band with mirror-finished inner and outer surfaces has an axial width that varies gradually from a first point of minimum width to a second point of maximum width, said first and second points being arranged diametrically with respect to each other.

3. The tubular skylight of claim 1, wherein said refracting body is ranged so as to surround said minor-finished body.

4. The tubular skylight of claim 3, wherein said reflecting body comprises a cylindrical body having an outer surface that forms prisms.

5. The tubular skylight of claim 4, wherein said cylindrical body of the reflecting body has at least one surface region thereof removed so as to provide an opening.

6. The tubular of claim 5, wherein said prisms formed at said outer surface of said cylindrical body are Fresnel-lens prisms shaped so as to redirect incoming light rays in a suitable direction.

7. The tubular skylight of claim 1, wherein said mirror-finished body and said refracting body are arranged coaxially with respect to said tubular body.

8. The tubular skylight of claim 7, further comprising brackets supporting said mirror-finished body, spokes provided at said brackets arranged radially, and notches provided at said spokes coupling to said refracting body.

9. The tubular skylight of claim 1, wherein said diffuser comprises a frame-shaped body, a flange provided on said frame-shaped body, a rim with rounded corners provided on said flange, said rim having a same perimetric shape as a circumference of said tubular body to allow coupling of said second end of said tubular body inside said rim.

10. The tubular skylight of claim 9, further comprising a plate supported at said frame-shaped body, said plate being made of translucent material; locking elements which are slidingly accommodated within a perimetric profile of said plate of translucent material for supporting said plate, said locking elements being removably inserted in said frame-shaped body.

11. The tubular skylight of claim 1 wherein said refracting body has an outer surface provided with prisms.

12. The tubular skylight of claim 11, wherein said refracting, cylindrical body has an opening provided by a missing circumferential surface region thereof.

13. The tubular of claim 11, wherein said prisms formed at said outer surface of said refracting body are Fresnel-lens prisms shaped so as to redirect incoming light rays in a suitable direction.

* * * * *